US005765328A

United States Patent [19]

Moore

[11] Patent Number: 5,765,328

[45] Date of Patent: *Jun. 16, 1998

[54] DRAINAGE SYSTEM FOR DECKS

[76] Inventor: Grant M. Moore, 3599 Aaron Sosebee Rd., Cumming, Ga. 30130

[ * ] Notice: The term of this patent shall not extend beyond the expiration date of Pat. No. 5,511,351.

[21] Appl. No.: 642,025

[22] Filed: Apr. 29, 1996

Related U.S. Application Data

[63] Continuation-in-part of Ser. No. 129,428, Sep. 29, 1993, Pat. No. 5,511,351.

[51] Int. Cl.[6] ..... E04B 1/70

[52] U.S. Cl. ..... 52/302.1; 52/11; 405/119

[58] Field of Search ..... 52/302.1, 302.3, 52/302.5, 462, 13, 11, 478, 596.04; 405/119

[56] References Cited

U.S. PATENT DOCUMENTS 4,065,883 1/1978 Thibodeau ..... 52/478 X 4,663,894 5/1987 LaRoch et al. ..... 52/15

4,860,502 8/1989 Mickelsen ..... 52/478 X

*Primary Examiner*—Creighton Smith

*Attorney, Agent, or Firm*—Isaf, Vaughan & Kerr

[57] ABSTRACT

A drainage system for a conventional deck assembly made of flexible material and mounted beneath the surface decking between adjacent deck joists. The drainage system is designed to collect water leaking through the spaces between adjacent deck cross pieces and channel it to a gutter and downspout, keeping the area beneath the deck dry. The deck drainage system consists of a plurality of water channeling members respectively formed from substantially flexible web material mounted side-by-side in succession and mounted in an overlapping relationship, straddling adjacent deck joists thereby removing the deck joists from view.

3 Claims, 8 Drawing Sheets 10
12
14
14d
14e
14g
16
17
18
19
20
21
22
26a
26b
28
29
34
40
60
61
62
63
64
65
66

DRAINAGE SYSTEM FOR DECKS

This document is a continuation-in-part of the application entitled "DRAINAGE SYSTEM FOR DECKS," filed Sep. 29, 1993, by Grant M. Moore, that was assigned Ser. No. 08/129,428, now U.S. Pat. No. 5,511,351.

FIELD OF THE INVENTION

This invention relates to a deck assembly and is more particularly concerned with a drainage system for decks and a method of installing the same.

BACKGROUND OF THE INVENTION

The conventional deck construction such as a raised deck provides open cracks between the cross pieces comprising the deck surface so that water will drain through the cracks and not collect on the deck surface. However, the area below the deck, which may be used as a second patio or storage area is exposed to the elements of nature, particularly rain which passes through the openings or cracks in the deck. A deck drainage system that collects and channels water running through the cracks in a deck floor is disclosed in U.S. Pat. No. 4,065,883 to Thibodeau. Thibodeau utilizes a plurality of prefabricated gutters designed to be installed while the deck is under construction. Each gutter is fabricated with a base that slopes downwardly from one end to the other to facilitate the flow of water. The gutters rest between and on the deck joists, supported by flanges extending outwardly from the upstanding side members. However, the gutters must be manufactured at one site and then transported to the installation site. Once installed, Thibodeau's drainage system may not be removed without extensive destruction of the deck.

U.S. Pat. No. 4,860,502 to Mickelsen discloses a drainage system for decks that may be installed on existing decks. Mickelsen utilizes gutter hangers fastened at an incline to the interior surface of two adjacent deck joists. A gutter panel is then coupled between the two gutter hangers. As in Thibodeau, Mickelsen requires the gutter hangers and panels to be custom fabricated at one site and then transported to the installation site. Additionally, the deck joists remain visible in both designs.

BRIEF DESCRIPTION OF THE INVENTION

Briefly described, the present invention includes a conventional deck assembly having equally spaced longitudinally extending floor boards or cross pieces supported by spaced traverse deck joists and a deck drainage system made of flexible and light weight web material, which can be installed easily and inexpensively. In more detail, the deck drainage system of the present invention includes a plurality of water channeling members mounted in an overlapping relationship, straddling adjacent deck joists for directing collected water to a gutter and thence to a downspout.

The water channeling members are generally rectangular sheets, substantially uniform in width and length, made of any flexible and light weight web material that is waterproof, such as fire retardant sheets of plastic. The sheets, manufactured in standard widths, can be stored on a reel and later cut to the appropriate dimensions at the installation site. The water channeling members are installed by mounting the flexible sheets between two adjacent joists with fastening members such as T-50 staples and/or nails. The water channeling members are selectively mounted below the flooring to the deck joists in either of two different configurations. In one embodiment, the water channeling members are mounted to the vertical side surfaces of the deck joists at an incline with respect to the deck joists and forming successively U-shaped scallops defining the water channeling members to facilitate water flow away from the structure. In another embodiment, the water channeling members are mounted to the bottom surfaces of the deck joists where the decks are built at an incline in accordance with local building codes.

A gutter is installed transversely across the discharge ends of the water channeling members to collect water from the channeling members and direct it to a downspout where it is discharged by gravity in the normal fashion, thus, controlling erosion to the surface below. If desired, an inner gutter is disposed transversely below the proximate ends of the deck joists, the inner gutter being mounted to the bottom surface of the house header. The inner gutter is used to collect water which may drain through the space between the inner or proximate ends of the water channeling members and the house header and discharge this water at one or both ends of the inner gutter.

The deck drainage system of the present invention may be easily installed on decks under construction or on those decks already in existence.

Once installed, the drainage system creates a contemporary look, covering the unsightly joists. Additionally, the water channeling members may be produced in a variety of colors or painted, according to one's personal taste. Trim molding may be mounted to cover the exposed fasteners or to cover seams created by the water channeling members overlapping the deck joists.

Accordingly, it is an object of the present invention to provide a drainage system for decks which will provide effective protection from rain to items stored below the deck.

Another object of the present invention is to provide a drainage system for decks which is inexpensive to manufacture and install, durable in structure and efficient in operation.

Another object of the present invention is to provide a drainage system for decks which is contemporary in appearance and aesthetically valuable.

Another object of the present invention is to provide a drainage system for decks which covers the unsightly deck joists from view.

Another object of the present invention is to provide a drainage system for decks which involves fewer parts and is installed in less time.

Another object of the present invention is to provide a drainage system for decks that can be easily maintained and repaired.

Another object of the present invention is to provide a drainage system for decks that can be installed on a conventional deck regardless of whether or not the deck has cross bracing.

Another object of the present invention is to provide a drainage system for decks which will prevent or appreciably reduce erosion to the surface below the deck.

Another object of the present invention is to provide a drainage system for decks which can be easily removed without damage to the deck, or itself.

Other objects, features and advantages of the present invention will become apparent from the following detailed description when considered in conjunction with the accompanied drawings, wherein like characters of reference designate corresponding parts throughout the several views.

DETAILED DESCRIPTION OF THE PREFERRED EMBODIMENT

Figure 1:
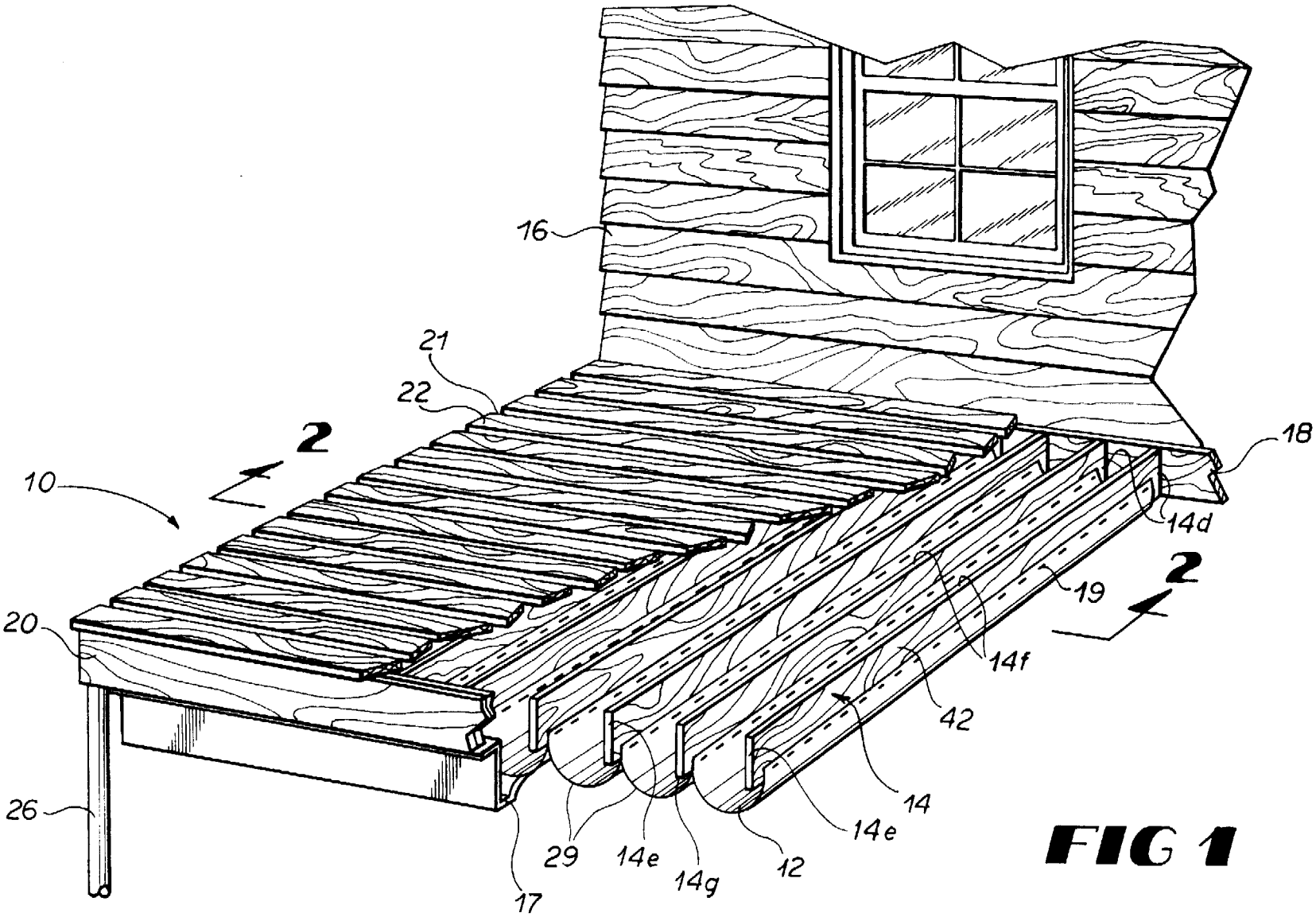
FIG. 1 is a fragmentary perspective view of a conventional deck structure attached to a house and having a drainage system constructed in accordance with the present invention incorporated therewith.

Referring now in detail to the embodiments chosen for the purpose of illustrating the present invention, FIG. 1 depicts a residential or commercial structure 16 having a generally horizontally extending conventional raised deck 10. The raised deck 10 is fixed to the structure 16 by means of a horizontal house header 18 which is disposed flat against and is fixed to the exterior wall of the structure 16. The house header 18 comprises one side of the generally rectangular support frame of the raised deck 10. The support frame generally consists of four beams secured together at their distal ends in a generally rectangular configuration. A beam 20 of the support frame is disposed parallel to and opposite the house header 18 and is supported by two upright posts 26. Disposed inside the support frame are a plurality of equally spaced, parallel, elongated, rectangular, deck joists 14, running longitudinally in a direction generally perpendicular to the house header 18 with their peripheral ends **14*d* abutting header 18 and their distal ends joined by the beam 20. Each joist 14 is thus provided with opposed parallel side surfaces 40 and 42, an upper surface 14*f*, and a lower or bottom surface 14*g***.

Transversely disposed across the top or upper surfaces **14*f* of the deck joists 14 are a plurality of cross pieces or plates 22 positioned on their sides parallel to one another. The cross pieces 22 are spaced an equal distance apart to provide small parallel cracks, openings or spaces between the side edges of adjacent cross pieces for water to pass through by gravity. Such cracks, openings or spaces 21 are transverse to the deck joists 14**.

In accordance with the present invention, a plurality of individual flexible water channeling members 12 are disposed in an overlapping relationship, straddling adjacent deck joists 14 in successive fashion. The water channeling members 12 are substantially rectangular in shape and uniform in thickness throughout. The preferred material for construction of the water channeling members 12 is flame retardant plastic such as PVC. The water channeling members 12 are of a length substantially the same as the deck joists 14, and a width equal to or greater than the distance between the center line of two adjacent deck joists 14. The water channeling members 12 are suspended successively between adjacent deck joists 14 so as to form troughs which collect water passing between adjacent cross pieces 22. The water collected by the water channeling members 12 is directed away from the structure 16 into a gutter 17 disposed adjacent to the distal ends 29 of all said water channeling members 12, preventing the area below the raised deck 10 from getting wet. Water that drains between the proximal ends 28 of channeling members 12 and the structure 16 is collected by an inner gutter 60 and discharged out one or both ends of the inner gutter 60.

The preferred embodiment of the inner gutter 60 is a Z-shaped member having a mounting flange 61 connected to the gutter bottom 63 by a connecting flange 62. Extending from the gutter bottom 63 is a reverse flange 64 to contain water collected, thus conducting water out one or both ends of the inner gutter so that it is dry below the raised deck 10.

The flexible web material of a prescribed width, from which the water channeling members 12 are formed may be supplied to the site in a reel (not shown) and cut transversely to length on the site.

Figure 2:
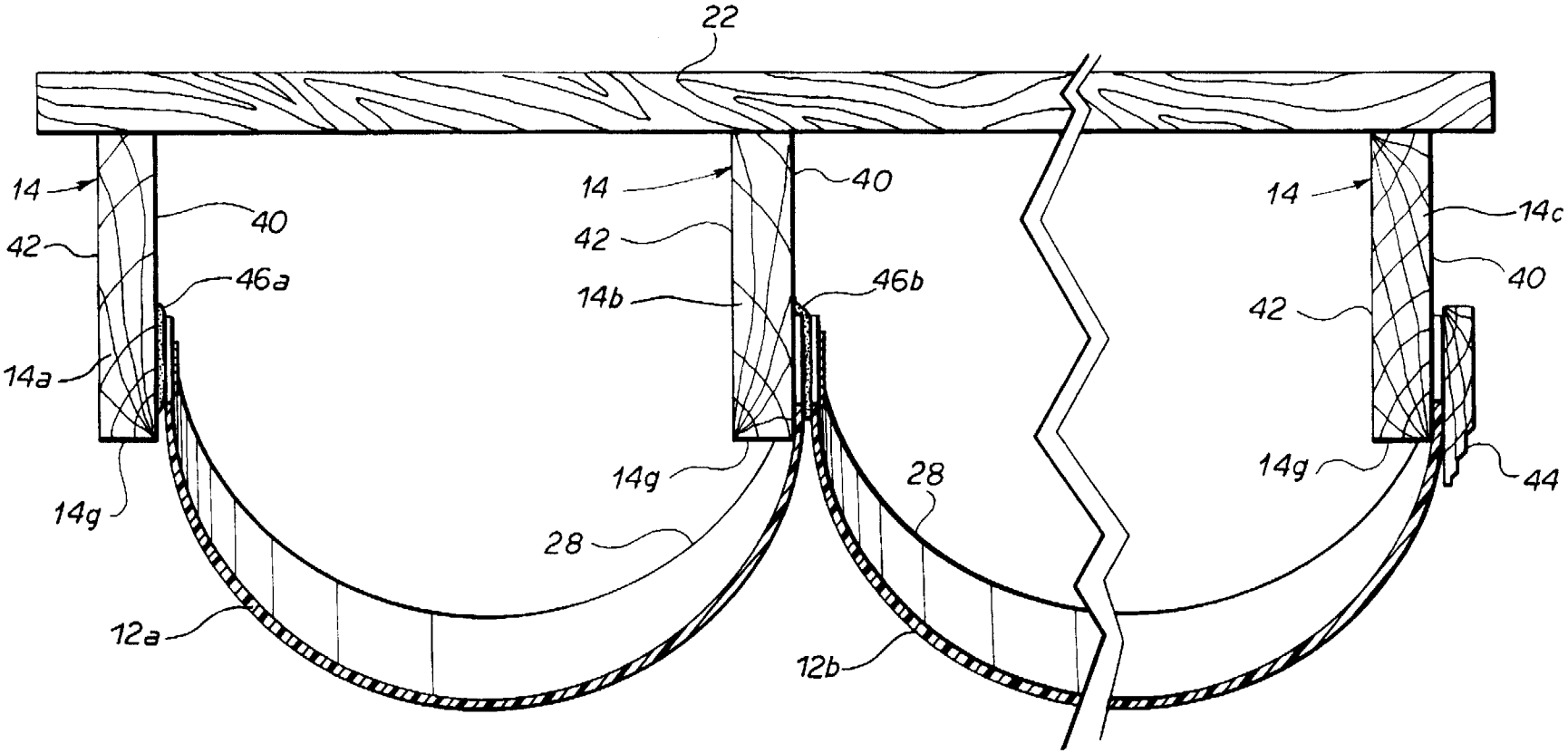
FIG. 2 is an enlarged fragmentary vertical sectional view taken substantially along line 2—2 in FIG. 1.

In the first embodiment shown in FIGS. 1 through **3*d*, a scalloped configuration of the water channeling members 12 is produced by cutting the web material to length and mounting them to the successive vertical side surfaces 40 and 42 of successive deck joists 14. Installation of the scalloped configuration should begin at an outermost joist 14*a* in FIG. 2 of the raised deck 10 and continues thereacross. As illustrated in FIG. 2, the first channeling member 12*a* is installed to the first deck joist 14*a* by securing one edge portion of water channeling member 12*a* to the inside vertical side surface 40 of deck joist 14*a* so as to overlap the lower portion of that side surface 40. This first edge portion of water channeling member 12*a* may, however, be fixed to the exterior vertical side surface 42 of deck joist 14*a*, if desired. A small bead of waterproof caulking 46*a*, approximately the length of water channeling member 12*a*, is disposed on vertical side surface 40 along the contact surface between deck joist 14***a* and water channeling member 12*a* prior to affixing the edge portion of each water channeling member 12, thus creating a waterproof seal. Regardless of which vertical side surface 40 or 42 of deck joist 14*a* the edge portion is fixed, the opposite edge portion of the water channeling member 12*a* is affixed to the right or far vertical side surface 40 of adjacent deck joist 14*b*, straddling deck joist 14*b* and overlapping the lower portion of its vertical side surface.

As seen best in FIG. 2, when the second edge portion of water channeling member 12*a* is being installed against a side surface 40, an edge portion of the next water channeling member 12*b* is disposed over the second edge portion of water channeling member 12*a*, in an overlapping fashion, with its edge aligned parallel to and juxtaposed with the edge of water channeling member 12*a*. Thus, as seen in FIG. 2, the channeling member 12*a* and 12*b* sag so as to be respectively concaved along substantially their entire upper surfaces and convexed along substantially their entire lower surfaces while having linear increments along substantially their entire lengths. A small bead of waterproof caulking 46*b*, approximately the length of water channeling member 12*a*, is applied to the other edge portion of water channeling member 12*a* prior to positioning the first portion of channeling member 12*b* against it so that these edge portions overlap. This creates a waterproof seal.

The opposite edge portion of water channeling member 12*b* is then affixed to the opposite vertical side surface 40 of the next adjacent deck joist 14*c*, straddling the deck joist 14*c* and overlapping the lower portion of its vertical side surface 40. The preferred means for affixing or securing the water channeling members 12*a* and 12*b*, respectively, to the deck joists 14*a* and 14*b* is applying a series of detents, such as staples 19 or the equivalent to the overlapping edge portions and into the deck joist 14*a* or 14*b*, as the case may be, spacing them substantially an equal distance apart, throughout the length of each deck joist 14. Then the overlapping and securing procedure, using successive water channeling members, is progressively repeated until a series of successive water channeling members 12 are suspended between all adjacent pair of said deck joists 14.

Figures 3A, 3B, 3C, 3D:
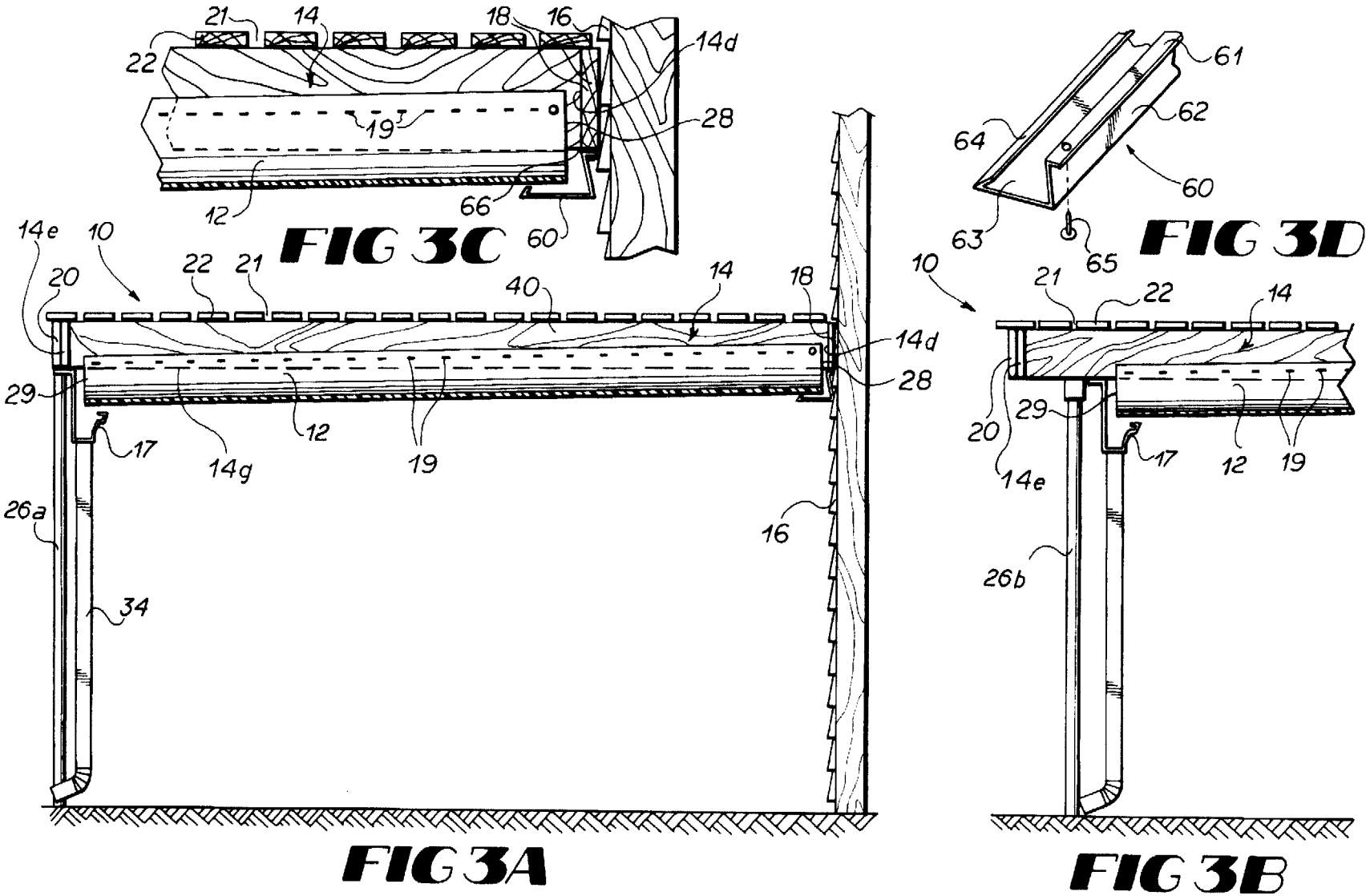
FIG. 3A is an partially broken away side elevational view of the deck and drainage system shown in FIG. 1.
FIG. 3B is a fragmentary side elevational view of a modified form of said deck drainage system of the deck shown in FIG. 1.
FIG. 3C is an enlarged fragmentary vertical sectional view of a portion of the deck structure of FIG. 1 showing the inner gutter attached to the house header thereof.
FIG. 3D is a fragmentary perspective view of the inner gutter illustrated in FIG. 3C.

Each individual water channeling member 12 is affixed to the deck joist 14 at an incline with respect to the deck joists 14 so that one series of adjacent ends 29 are lower than their other ends 28 to facilitate water flow away from the structure 16, as best illustrated in FIG. 3A. The seams on the outermost deck joists 14*a* and 14*c* created by fixing the water channeling members 12 to the vertical side surfaces 40 or 42 may be covered with trim molding 44 made of wood, aluminum or the equivalent as seen in FIG. 2.

FIG. 3B illustrates an alternative configuration of the first preferred embodiment. In FIG. 3B, the first preferred embodiment is installed on the raised deck 10 with recessed upright posts 26*b*. In this configuration, the water channeling members 12 will be cut to the appropriate length and installed in like manner. A gutter 17 may be attached beneath all distal ends 29 of the scalloped configuration as illustrated in FIGS. 3A and 3B. The gutter 17 is a specially manufactured gutter with a high back to accommodate the scalloped water channeling members 12. Both FIG. 3A and 3B illustrate a downspout 34 which disposes of water collected in the gutter 17 in the normal way.

Figure 4:
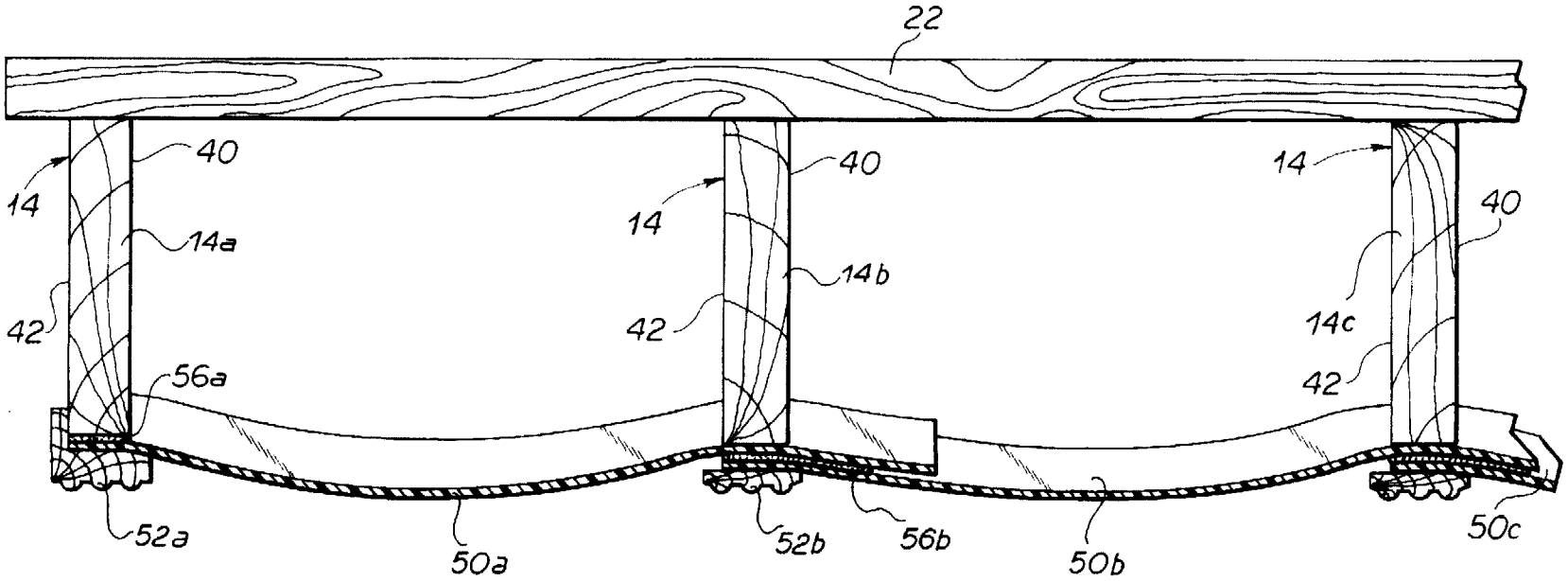
FIG. 4 is an enlarged fragmentary cross section of a portion of a second embodiment of the present invention showing the flat configuration of the deck drainage system.
Figure 5:
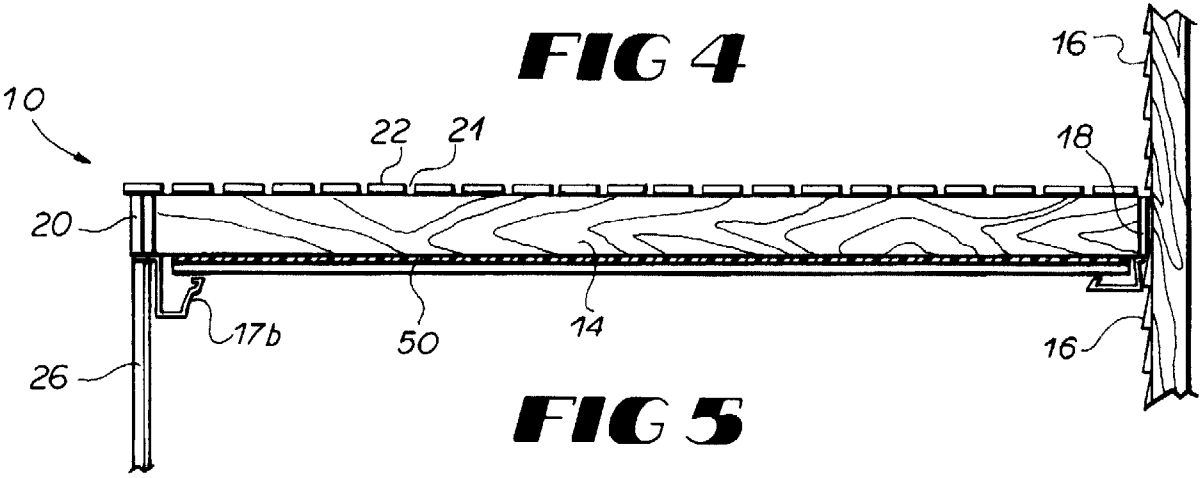
FIG. 5 is a fragmentary side elevational view of the second embodiment shown in FIG. 4 showing the flat configuration of this deck drainage system.
Figure 6:
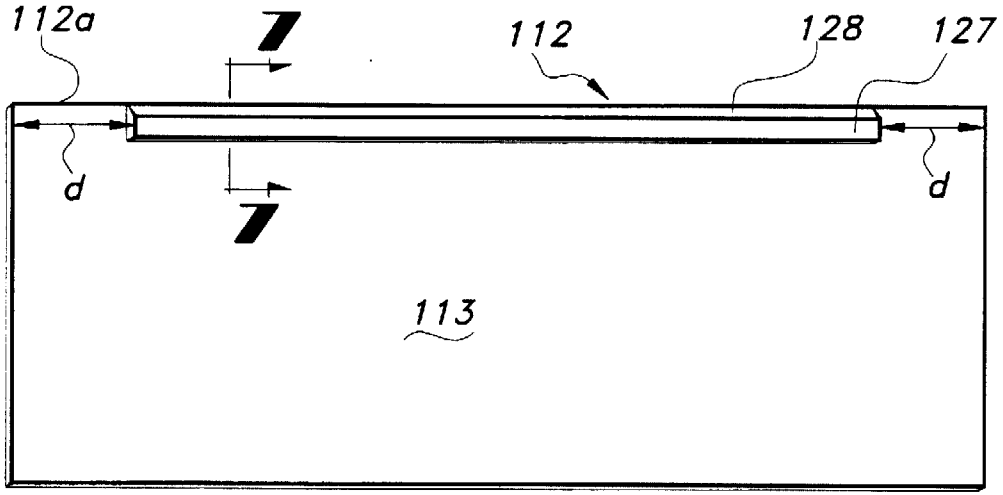
FIG. 6 is a perspective view of a flexible drainage assembly of a third embodiment of the present invention.

The second preferred embodiment known as the flat configuration utilizes the incline built into the patio decks 10 in accordance with local building codes, as illustrated in FIGS. 4 and 5. The incline of the deck facilitates water flow away from the structure 16. The water channeling members 50*a*, 50*b*, 50*c* are fixed between adjacent deck 10 joists 14*a*, 14*b*, 14*c* with edge portions overlapping at the bottom surface 14*g* of each individual deck joist 14*a*, 14*b*, 14*c*. When the water channeling members 50*a*, 50*b*, 50*c* are not wide enough to overlap adjacent water channeling members 50*a*, 50*b*, 50*c*, the water channeling members 50*a*, 50*b*, 50*c* are disposed contiguous and the edge portions of the water channeling members 50*a*, 50*b*, 50*c* are fixed to the bottom surface of the deck joists 14*a* and 14*b*.

Installation of the flat configuration begins by fixing the edge portion of water channeling member 50*a* to the bottom surface of deck joist 14*a*, as illustrated in FIG. 4. This initial step is performed on an outermost deck joist 14*a* of the raised deck 10. A small bead of waterproof caulking 56*a*, approximately the length of water channeling member 50*a*, is disposed on the bottom surface 14*f* of deck joist 14*a*, thus creating a waterproof seal. Right angle trim molding 52*a* is then fixed to deck joist 14*a*, covering the seam created by fixing the water channeling member 50*a* to deck joist 14*a*. The opposite edge portion of water channeling member 50*a* is disposed across the bottom surface of deck joist 14*b* where it is fixed so that water channeling member 50*a* is substantially horizontal with its body slightly concave as it is suspended between deck joist 14*a* and 14*b*.

The edge portion of the next water channeling member 50*b* is fixed to the bottom surface of deck joist 14*b* overlapping the edge portion of water channeling member 50*a* that overlapped deck joist 14*b*. Prior to fixing water channeling member 50*b*, a small bead of waterproof caulking 56*b* is disposed on water channeling member 50*a* where it will be overlapped by water channeling member 50*b*, thus creating a waterproof seal. Trim molding 52*b* is fixed over the seam created by water channeling members 50*a* and 50*b* at the bottom surface of deck joist 14*b*. The opposite edge of water channeling member 50*b* is fixed to the bottom surface of the next adjacent deck joist 14*c*. Then the overlapping and securing procedure using successive water channeling members is progressively repeated until a series of successive water channeling members 50 are mounted between each adjacent pair of said deck joists 14*a*, 14*b*, 14*c*, etc.

As a result, as best seen in FIG. 5, the drainage system, designated generally by numeral 50, is nearly flush to the underside of the raised deck 10. With this embodiment, the standard gutter 17*b* is utilized to collect water discharged from the ends of the water channeling members 50 and direct it to a downspout in FIG. 5.

If desired, the inner gutter 60, seen in FIGS. 3C and 3D may be provided for catching the water which may drain down between the house header 18 and the proximal end of all of the channeling members 12. In more detail, this inner gutter 60 is formed of a pliable material such as sheet metal which is bent in the shape illustrated in FIGS. 3C and 3D. This gutter 60 includes a rectangular upper mounting flange 61 which is mounted against the bottom surface of the house header 18 and is secured in place by means of nails, such as nail 65 or other fastening means. A layer of waterproof caulking 66 is disposed between the inner gutter 60 and the house header 18 creating a waterproof seal between the inner gutter 60 and house header 18, and the house header 18 and structure 16. A support flange 62 forms one edge of the mounting plate 61 and terminates in a lower edge about which the metal is bent so as to provide an outwardly extending horizontally disposed gutter bottom 63, the outer edge portion which is reversely bent to provide an upwardly inclined flange plate 64 which terminates below the proximal end portions of all water channeling members 12.

The material forming the gutter 60 is so bent as to form a Z-shaped cross section and consists of the flange 61, the panel 62 and the bottom 63. The purpose of the Z-shape is to bias the common edge between the member 62 and 63 against the wall 16 of the structure.

When installing the gutter 60, the gutter is deformed forwardly so as to enable the nails such as nail 65 to be mounted into place securing the plate 61 to the head of. The bottom 63 of the gutter 60 is disposed essentially horizontally, therefore any accumulation of water in the cross portion of the gutter will eventually drain to one side or the other of the gutter, thereby discharging the water on one side or the other of the raised deck 10.

Figure 8:
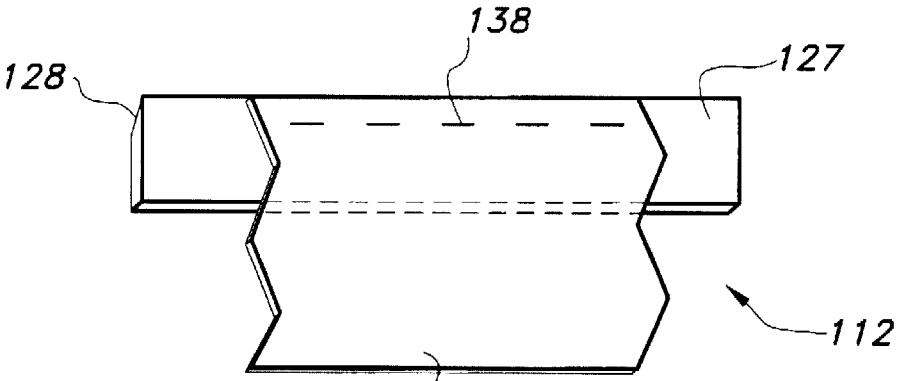
FIG. 8 is a fragmentary rear view of a section of the drainage assembly of FIG. 6, showing fasteners which join the drain sheet to the stabilizing bar.
Figure 7:
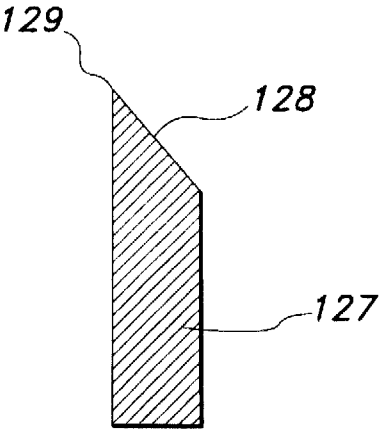
FIG. 7 is a vertical sectional view taken along line 7—7 in FIG. 6.

Another embodiment of the present invention includes a modified water channeling member or drainage assembly and associated mounting components. In this third embodiment, the water channeling member comprises a drainage assembly 112 which includes a planar, rectangular web or sheet 113 comprised of flexible plastic, aluminum or other flexible, substantially water resistant or waterproof material. Sheet 113 is of a length sufficient to span the entire length of the supporting deck joist 114, which corresponds to joists 14 described above. Additionally, sheet 113 is of a width sufficient to span the distance between immediately adjacent deck joists 114 while providing sufficient area or surface for mounting and for curving downwardly between adjacent joists in a preferably uniform scallop arrangement. Drainage assembly 112 includes an elongate stabilizing bar 127, which preferably is formed of a one inch by two inch wood or aluminum fining strip, and having a beveled or tapered edge 128 (FIG. 7). Prior to mounting the drainage assembly 112 onto a deck joist 114, stabilizing bar 127 is attached to one side of strip 113 so that the upper edge portion 129 of bar 127 is flush with the upper elongate edge 112*a* of sheet 113. As shown in FIG. 8 which depicts a rear view of bar 127 mounted to sheet 113, the sheet can be mounted to the bar by for example inserting staples 138 from the back edge of sheet 113 and into the wooden bar or firring strip 127. Other mounting means such as screws, nails or adhesive are satisfactory. The stabilizing bar is mounted to sheet 113 so that sheet 113 overlaps or extends outwardly from each end of bar 127 approximately three inches, which is represented by distance d.

Figure 9:
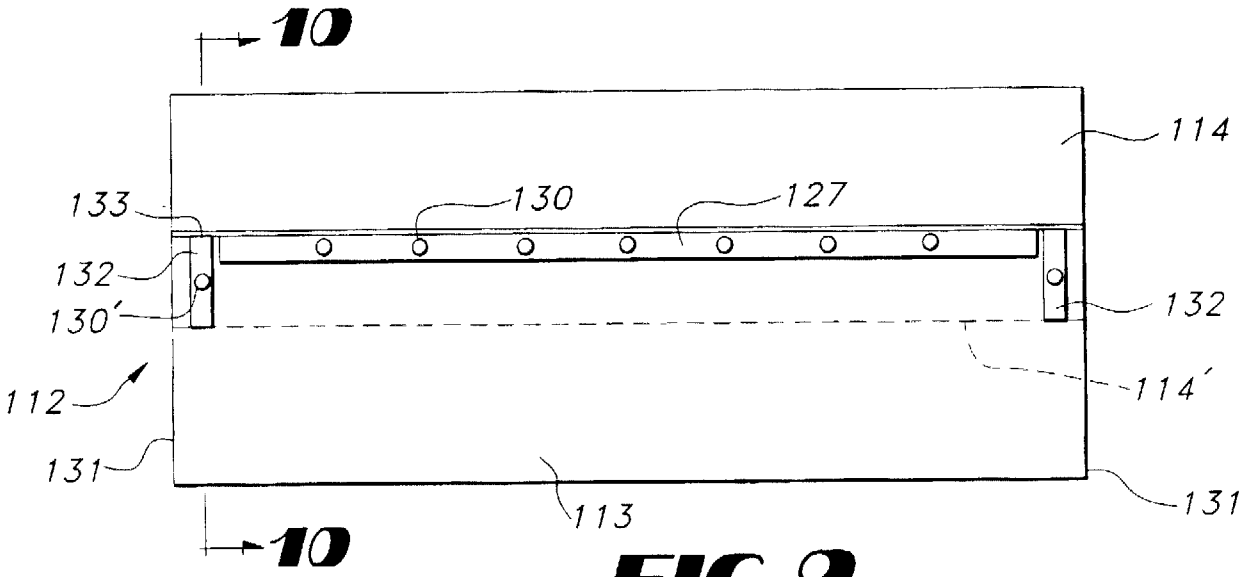
FIG. 9 is an elevational side view of the drainage assembly attached to a deck joist.

The drainage assembly 112 then is mounted to the inside edge of a deck joist 114 as shown in FIG. 9. As described above with respect to the first and second embodiments, drainage assembly 112 is first mounted to the inner side of an end joist, or one of the joists at the end or outer edge of the deck. Successive drainage assemblies are thereafter mounted between each respective deck joists across the width of the deck. As shown in FIG. 9, fasteners such as screws or nails 130 are passed through strip 127 and into joists 114 to securely attach drainage assembly 112 to joist 114. The end edges 131 of sheet 113 align with the respective ends of joist 114. At this point, two downwardly depending firring strips or bars 132 are mounted to joist 114 as shown in FIG. 9. One bar 132 is mounted at each end of stabilizing bar 127 so that it extends downwardly to hold the ends of web 113 against joist 114. The lower edge of bar 132 is flush with the lower edge 114' of deck joist 114. A bead of caulking 133 is then placed along the upper edge portion 129 of bar 127 extending the entire length of sheet 113, even above bars 132, and against joist 114, as shown in FIG. 9.

Figure 11:
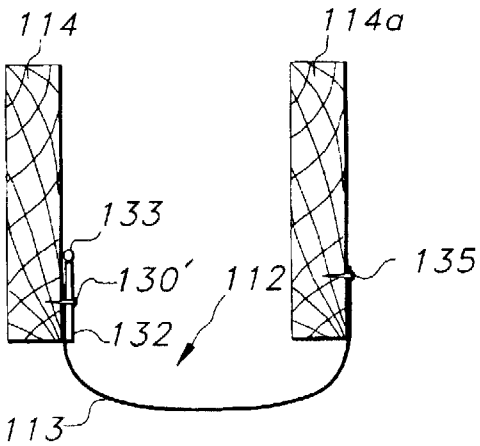
FIG. 11 is a fragmentary end view of a drainage assembly attached to adjacent deck joists.
Figure 10:
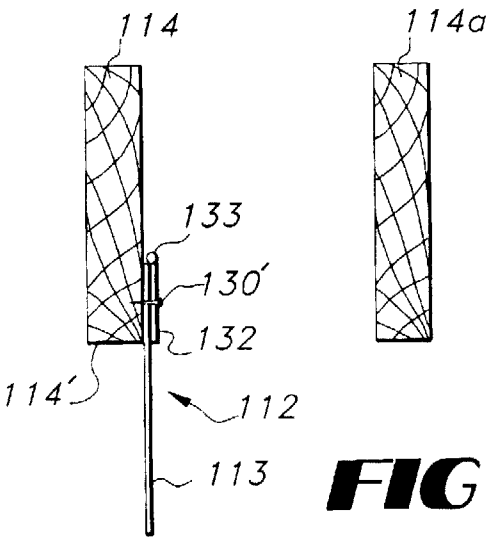
FIG. 10 is a fragmentary end view of a drainage assembly attached to a deck joist along one side taken along line 10—10 of FIG. 9.

FIG. 10 shows a cross-sectional view of the arrangement of FIG. 9 with assembly 112 attached to joist 114. Also shown in FIG. 10 is the next adjacent, or juxtaposed, joist 114*a* which is inward with respect to joist 114. In FIG. 11, assembly 112 has been wrapped around joist 114*a* and temporarily fastened, such as by staple 135 to the vertical side edge of joist 114*a* furthest away from joist 114. As shown in FIG. 11, the downwardly depending strip 132 extending below the lower edge of joist 114 keeps the curvature of sheet 113 uniform between joists 114 and 114*a*, thereby creating a scalloped appearance without undesirable offcenter bowing.

Figure 12:
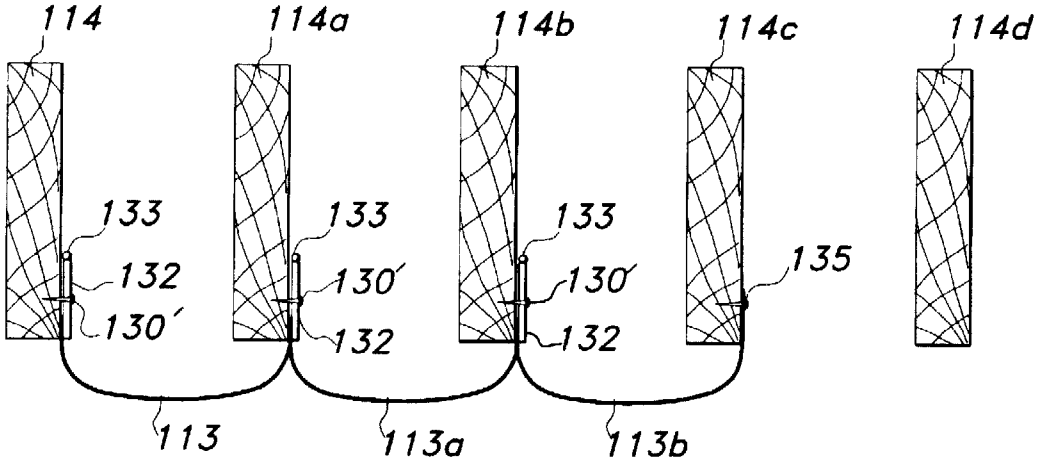
FIG. 12 is a fragmentary end view of several deck joists respectively joined together by drainage assemblies.

FIG. 12 shows joists 114, 114*a*, 114*b*, 114*c*, and 114*d* with successive drainage assemblies 112 mounted between joists 114–114*c*. In FIG. 12, joist 114*d* represents the last or outermost joist along the deck. This figure shows completed assemblies except for the drainage assembly between the last two deck joists, 114*c* and 114*d* and the absence of a stabilizing bar along the outer side of joist 114*c* against sheet 113.

Figure 13:
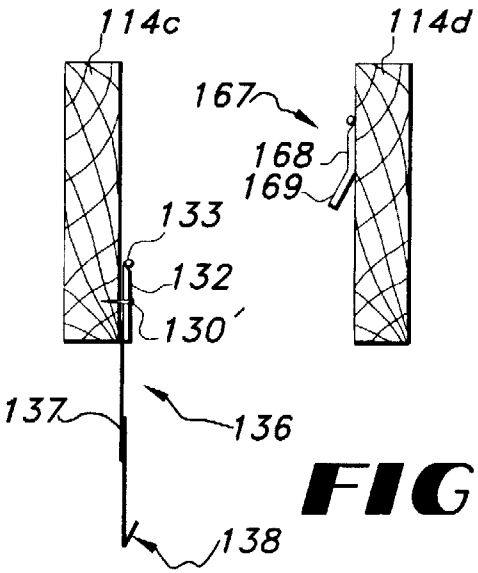
FIG. 13 is a fragmentary end view of a final drainage assembly attached to the next to last deck joist along one side.

For functional and appearance purposes, the last assembly 136 is somewhat structurally different from assembly 112, and is mounted differently than described above. As shown in FIG. 13, assembly 136 includes sheet 137 which is substantially identical to sheet 113, except that it has an upwardly bent edge portion 138 along its lower or free end. Otherwise, assembly 136 includes all elements referred to above with respect to assembly 112, including downwardly depending strip or bar 132, which also can be beveled or tapered such as beveled surface 128 of bar 127.

A facia or drip edge 167 comprised of any suitable material such as aluminum, plastic, wood or the like then is fastened to the inner surface of joist 114*d*, as shown in FIG. 13. Facia or flashing 167 has vertical plate 168 and angled plate 169 which extends out from joist 114*d*. Facia 167 extends the entire length of joist 114*d*. A bead of caulking 172 is placed along the upper edge of plate 168 and against joist 114*d* as shown in FIG. 13.

Figure 14:
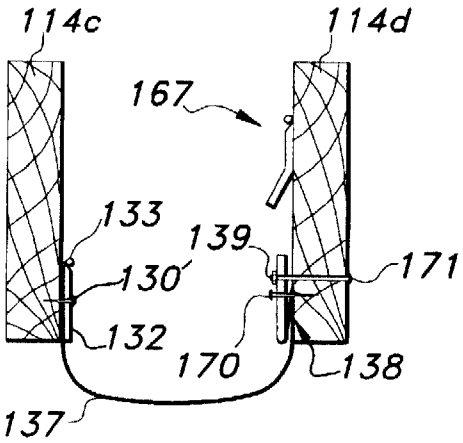
FIG. 14 is a fragmentary end view of a final drainage assembly attached to the last deck joist.

FIG. 14 shows assembly 136 then being attached at its free end with bent edge 138, to the inner vertical surface of the last or outermost joist 114*d* below facia 167. This last drainage section 136 includes a second stabilizing bar 139 which corresponds in length to the length of sheet 137. Bar 139 initially is loosely attached to the inner side edge of deck joist 114*d* by fastener 170, which can be a screw, nail or other suitable means. Sheet 137 is positioned between joists 114*c* and 114*d* so that bent edge 138 tucks between strip 139 and inner edge of joist 114*d*. While sheet 137 is held in place by frictional engagement of end 138 between strip 139 and joist 114*d*, a series of fasteners, such as screws 171 are passed from the outer edge of joist 114*d* through joist 114*d* and into strip 139. The continued tightening of screws 171 will pull strip 139 tightly against the inner edge of joist 114*d* and thereby hold edge 138 of sheet 137 firmly in place. Water running down the inner surface of joist 114*d* above facia 167 will be channeled by facia 167 toward web 137 so that the water preferably does not run over bar 139.

It is evident from the drawing figures and above descriptions that when the drainage system is installed, the respective sheets extending between immediately adjacent joists form concave surfaces extending upwardly which catch water or debris falling through openings 21 between decking 22 just as shown in FIG. 1 in this respect. Also as described above with the first and second embodiments, the drainage assemblies are mounted to the joists so that the assemblies gently angle downwardly away from a building or structure 16 so that the water runs by gravity away from the building.

Figure 16:
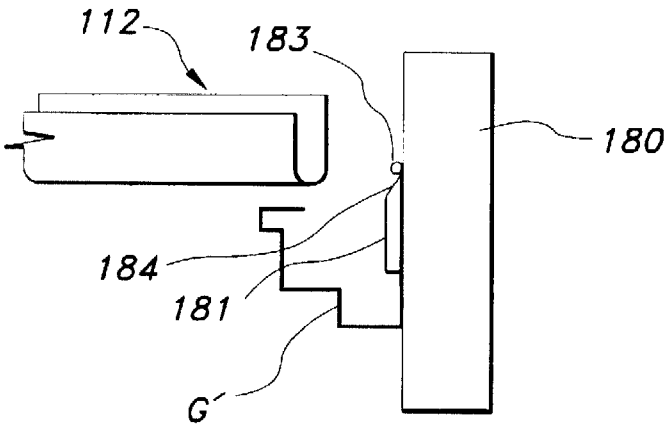
FIG. 16 is a schematic sectional view showing a second gutter attached to a deck band.
Figure 15:
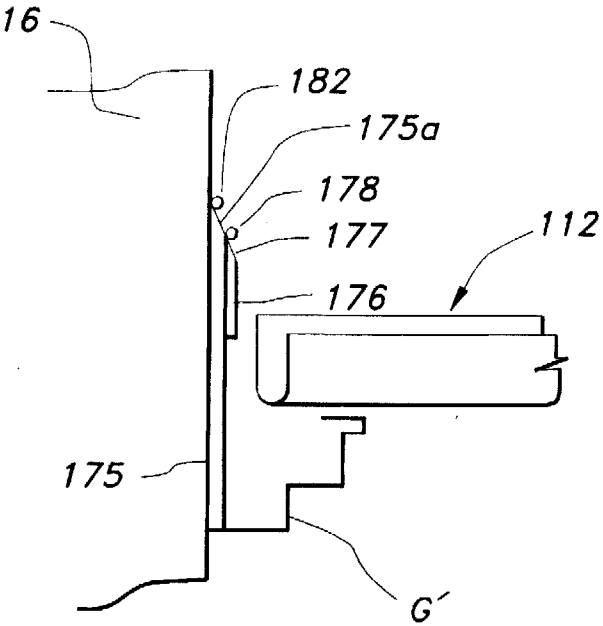
FIG. 15 is a schematic sectional view showing a first gutter attached to a gutter board.

Gutters extending transversely to the drainage assemblies and the deck joists are mounted at each end of the drainage assemblies. For example, one transversely extended gutter is mounted to a gutter board which is first mounted to the structure 16. As shown in FIG. 15, a gutter board 175 having an angled upper edge 175*a* is mounted by any suitable fastening means such as bolts, pins, or nails to structure 16. Caulking 182 is laid the entire length of board 175 and against structure 16. A firring strip 176 having an angled or tapered edge 177 is mounted to the gutter board 175. A bead of caulking 178 is laid along the entire length of strip 176 at the upper tapered edge where it meets and aligns with edge 175*a*, as shown in FIG. 15. A gutter G is thereafter mounted by any suitable fastening means to gutter board 175 below strip or drip edge 176. This gutter catches any water running between the inner end, or the end closest to structure 16, of drainage assembly 112 and structure 16. Gutter G is gently angled to one side so that it allows water to run towards one end and down a downspout (not shown). Similarly, a second transverse gutter G' is mounted to a second gutter board or deck band 180 at the opposite or outer end of drainage assembly 112 away from structure 16, as shown in FIG. 16. As with the arrangement shown in FIG. 15, a wooden or metal strip 181 is mounted to deck band 180 and includes an upwardly tapered edge 184. A strip of caulking 183 runs along the tapered edge of strip 181 at deck band 180. A gutter G' is mounted below strip 181 to catch the water running outwardly, away from structure 16 on the upwardly extending drainage assemblies 112. As with the embodiments discussed above, outer gutter G' is angled toward one end to channel the water and debris to and down a downspout (not shown).

It should be evident from the drawing FIGS. 6–16 and associated description that the drainage system of this third embodiment performs the same general function as that of the first and second embodiments, respectively. The difference, however, is in the individual components of the individual drainage assemblies and the method of their installation to the deck joists.

It will be obvious to those skilled in the art that many variations may be made to the embodiment here chosen for the purpose of illustrating the present invention without departing from the scope thereof as defined in the appended claims.

I claim:

1. A deck drainage system for collecting and channeling water passing through cracks of a deck floor, said system comprising:

a deck joist extending beneath and supporting cross pieces; and a plurality of interconnected drainage assemblies, each assembly of said plurality of interconnected drainage assemblies including a sheet of substantially waterproof material having first and second side edges, an elongate stabilizing bar positioned adjacent one of said first and second side edges of said sheet, and fastening means passing through said stabilizing bar, said sheet, and into said deck joist that holds said sheet to said deck joist, said stabilizer bar being attached flush against said sheet and said deck joist, thereby, substantially sealing said sheet between said deck joist and said stabilizer bar.

2. The deck drainage system of claim 1 wherein said deck joist includes a lower edge, and wherein said system further comprises a downwardly extending support bar, said support bar being attached to said deck joist adjacent to said stabilizing bar and extending downwardly toward the lower edge of said deck joist.

3. The deck drainage system of claim 2 further comprising a sealing element, and wherein said stabilizer bar includes an upper edge, said upper edge having said sealing element adhered thereto.

* * * * *